US011592222B2

(12) United States Patent
Park et al.

(10) Patent No.: US 11,592,222 B2
(45) Date of Patent: Feb. 28, 2023

(54) CONDENSER FOR REFRIGERATOR

(71) Applicant: LG ELECTRONICS INC., Seoul (KR)

(72) Inventors: Taegyun Park, Seoul (KR); Juhyok Kim, Seoul (KR); Jiwon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 201 days.

(21) Appl. No.: 16/648,984

(22) PCT Filed: Sep. 19, 2018

(86) PCT No.: PCT/KR2018/011023
§ 371 (c)(1),
(2) Date: Mar. 19, 2020

(87) PCT Pub. No.: WO2019/059626
PCT Pub. Date: Mar. 28, 2019

(65) Prior Publication Data

US 2020/0284482 A1 Sep. 10, 2020

(30) Foreign Application Priority Data

Sep. 19, 2017 (KR) ..... 10-2017-0120630

(51) Int. Cl.
*F25B 39/04* (2006.01)
*F28D 1/053* (2006.01)
(Continued)

(52) U.S. Cl.
CPC ..... *F25B 39/04* (2013.01); *F28D 1/05391* (2013.01); *F28D 2021/0071* (2013.01);
(Continued)

(58) Field of Classification Search
CPC ..... F25B 39/04; F28D 1/05391; F28D 2021/0071; F28D 2021/0084; F28F 1/022; F28F 9/02; F28F 2215/12; F28F 2260/02
(Continued)

(56) References Cited

U.S. PATENT DOCUMENTS 2,911,801 A * 11/1959 Buehler, Jr. ..... F25B 39/04 62/305
2,995,906 A * 8/1961 Brandimarte ..... F25D 17/067 62/427
(Continued)

FOREIGN PATENT DOCUMENTS

EP 2995886 3/2016
JP 2997818 1/2000
(Continued)

OTHER PUBLICATIONS

International Search Report dated Jan. 11, 2019 issued in Application No. PCT/KR2018/011023.
(Continued)

*Primary Examiner* — Tho V Duong
*Assistant Examiner* — Raheena R Malik
(74) *Attorney, Agent, or Firm* — Ked & Associates, LLP

(57) ABSTRACT

A condenser for a refrigerator according the present invention includes a heat exchange unit configured to receive at one side thereof refrigerant, which has been compressed in a compressor, to perform heat exchange between the refrigerant and air and to discharge the refrigerant, which has exchanged heat with the air, to an evaporator, wherein the heat exchange unit includes a flat tube, through one end of which the refrigerant is introduced and through a remaining end of which the refrigerant is discharged, thereby performing heat exchange between the refrigerant and the air,
(Continued)

wherein the flat tube includes at least one bent tube portion defining plural rows of tubes, which are spaced apart from each other in an up-and-down direction, and wherein the plural rows of tubes define an intersection bent surface, which has a predetermined curvature and intersects the up-and-down direction.

20 Claims, 10 Drawing Sheets

(51) Int. Cl.
*F28D 21/00* (2006.01)
*F28F 1/02* (2006.01)
*F28F 9/02* (2006.01)

(52) U.S. Cl.
CPC ..... *F28D 2021/0084* (2013.01); *F28F 1/022* (2013.01); *F28F 9/02* (2013.01); *F28F 2215/12* (2013.01); *F28F 2260/02* (2013.01)

(58) Field of Classification Search
USPC ..... 165/173
See application file for complete search history.

(56) References Cited

U.S. PATENT DOCUMENTS 3,255,609 A * 6/1966 Jacobs ..... F28D 1/0213 62/392
3,416,600 A * 12/1968 Fink ..... F28F 1/022 165/175
3,638,445 A * 2/1972 Lavigne, Jr. ..... F28B 1/06 62/184
3,943,728 A * 3/1976 Maudlin ..... F25B 39/04 62/507
6,546,999 B1 * 4/2003 Dienhart ..... F28D 1/0476 165/150
6,804,976 B1 * 10/2004 Dain ..... F25B 39/02 165/148
7,779,898 B2 * 8/2010 Morrison ..... F28D 1/0477 165/150
2007/0204978 A1 * 9/2007 Beamer ..... F28D 1/05366 165/124
2008/0302518 A1 * 12/2008 Durdel ..... F28F 1/22 165/148
2011/0139425 A1 * 6/2011 Beamer ..... F28D 1/0476 165/175
2014/0284031 A1 * 9/2014 Lee ..... F28F 1/325 165/121
2015/0323229 A1 * 11/2015 Kim ..... F28D 1/0535 165/104.21

FOREIGN PATENT DOCUMENTS

JP 2000-258094 9/2000
KR 10-2006-0017395 2/2006
KR 10-2009-0096030 9/2009
KR 10-2015-0129250 11/2015
WO WO 2015/043676 4/2015
WO WO 2016/173790 11/2016
WO WO 2016/177803 11/2016
WO WO 2017/099434 6/2017

OTHER PUBLICATIONS

European Search Report dated May 26, 2021 issued in Application No. 18857735.7.

* cited by examiner

CONDENSER FOR REFRIGERATOR

CROSS-REFERENCE TO RELATED PATENT APPLICATIONS

This application is a U.S. National Stage Application under 35 U.S.C. § 371 of PCT Application No. PCT/KR2018/011023, filed Sep. 19, 2018, which claims priority to Korean Patent Application No. 10-2017-0120630, filed Sep. 19, 2017, whose entire disclosures are hereby incorporated by reference.

TECHNICAL FIELD

The present invention relates to a condenser for a refrigerator.

BACKGROUND ART

In general, a heat exchanger may be used as a condenser or an evaporator in a refrigeration cycle apparatus composed of a compressor, a condenser, an expansion mechanism and an evaporator.

The heat exchanger is mounted on a vehicle, a refrigerator or the like so as to perform heat exchange between refrigerant and air.

The heat exchanger may be classified into a fin tube-type heat exchanger, a microchannel-type heat exchanger and the like.

The fin tube-type heat exchanger is made of copper, and the microchannel-type heat exchanger is made of aluminum.

Because a spiral condenser, which is applied to a small-sized refrigeration cycle, includes one inlet pipe and one outlet pipe, freedom in a pass configuration is at a low level. Furthermore, the spiral condenser is disadvantageous in that it is difficult to insert a structure such as a louver (a slit, a dimple or the like) because the fin thereof is small and has a circular cross-sectional shape and efficiency is lowered because loss of air pressure is increased due to introduction of air only through one side thereof.

Because the microchannel-type heat exchanger has fine flow channels therein, there is an advantage in that efficiency is improved, compared to the fin tube-type heat exchanger. However, there is a problem in that a flow channel is deformed or blocked when the heat exchanger is bent in configuration of a refrigerant passage. The microchannel-type heat exchanger is constructed such that headers are connected to two ends of each of a plurality of tubes. However, the microchannel-type heat exchanger, in which the headers are connected to the plurality of tubes, has disadvantages in that manufacturing costs are increased and it is difficult to use when the space in a machine room is small.

DISCLOSURE

Technical Problem

Therefore, the present invention has been made in view of the above problems, and it is an object of the present invention to provide a condenser for a refrigerator capable of allowing plural rows of heat exchange units to be efficiently disposed in a confined space.

It is another object of the present invention to provide a condenser capable of ensuring a sufficient heat-transfer area in a machine room having a narrow space and of making it advantageous to prevent loss of air pressure.

It is a further object of the present invention to provide a condenser capable of being easily bent without reducing a flow channel when plural rows are formed in a narrow space.

Objects of the present invention are not limited to the above-mentioned objects, and other objects, which are not mentioned, will be apparent to those skilled in the art from the following description.

Technical Solution

A condenser for a refrigerator according to the present invention is characterized in that a plurality of flat tubes are bent multiple times so as to form plural rows and a longer side each of the plurality of flat tubes is disposed parallel to a direction of airflow.

Specifically, the condenser for a refrigerator according to the present invention includes a heat exchange unit configured to receive, at one side thereof, refrigerant which has been compressed in a compressor, to perform heat exchange between the refrigerant and air and to discharge the refrigerant, which has exchanged heat with the air, to an evaporator, wherein the heat exchange unit includes a flat tube, through one end of which the refrigerant is introduced and through a remaining end of which the refrigerant is discharged, thereby performing heat exchange between the refrigerant and the air, wherein the flat tube includes at least one bent tube portion defining plural rows of tubes, which are spaced apart from each other in an up-and-down direction, and wherein the plural rows of tubes define an intersection bent surface, which has a predetermined curvature and intersects the up-and-down direction.

The bent tube surface of the intersection bent portion and a bent surface of the bent tube portion may be disposed in a direction so as to intersect each other.

The flat tube may have a horizontal width, which is larger than a vertical thickness of the flat tube.

The flat tube may have a longer side which is disposed parallel to the bent surface of the intersection bent portion.

The flat tube may have a longer side which is disposed in a direction so as to intersect a bent surface of the bent tube portion.

The intersection bent portion may have a radius of curvature which is larger than a radius of curvature of the bent tube portion.

A ratio of a radius of curvature of the intersection bent portion to a horizontal width of the flat tube may be 3-5:1.

A ratio of the bent tube portion to a vertical thickness of the flat tube may be 5.5-7:1.

A ratio of a vertical thickness of the flat tube to a pitch of the plural rows of tubes may be 1:5.5-7.

The condenser for a refrigerator may further include an inflow header configured to supply the refrigerant, which has been compressed in the compressor, to the heat exchange unit, and an outflow header through which the refrigerant, which has exchanged heat with the air in the heat exchange unit, flows, wherein the inflow header is connected to the one end of the flat tube, and the outflow header is connected to the remaining end of the flat tube.

The condenser for a refrigerator may further include a fin connecting the plural rows of tubes to each other in order to transfer heat.

The plural rows of tubes may define two heat exchange surfaces, which face each other.

The bent surface of the bent tube portion may be parallel to the up-and-down direction.

The intersection bent surface may be perpendicular to the up-and-down direction.

A direction in which the air flows may be parallel to the bent surface of the intersection bent portion and intersects the bent surface of the bent tube portion.

A refrigerator according to the present invention includes a body having a storage compartment for storing foodstuffs, a door configured to open and close the body, and a condenser configured to condense refrigerant for cooling the storage compartment, wherein the condenser includes a heat exchange unit configured to receive, at one side thereof, the refrigerant, which has been compressed in a compressor, to perform heat exchange between the refrigerant and air and to discharge the refrigerant, which has exchanged heat with the air, to an evaporator, wherein the heat exchange unit includes a flat tube, through one end of which the refrigerant is introduced and through a remaining end of which the refrigerant is discharged, thereby performing heat exchange between the refrigerant and the air, wherein the flat tube includes at least one bent tube portion defining plural rows of tubes, which are spaced apart from each other in an up-and-down direction, and wherein the plural rows of tubes define an intersection bent surface which has a predetermined curvature and intersects the up-and-down direction.

The flat tube may have a longer side which is disposed parallel to the bent surface of the intersection bent portion.

Advantageous Effects

The condenser for a refrigerator according to the present invention offers one or more of the following effects.

First, there is an advantage in that it is possible to ensure a sufficient heat-transfer area in a confined space in a machine room and to make it advantageous to prevent loss of air pressure.

Second, there is an advantage in that heat transfer units are disposed in multiple rows, thereby optimizing space utilization, suppressing deformation of a bent portion and preventing reduction of a flow channel.

Third, there is an advantage in that a single flat tube is bent in a zigzag fashion in an up-and-down direction so as to define plural rows and the plural rows of tubes are further bent in another direction, thereby enabling a confined space in a machine room to be efficiently utilized without interfering with airflow.

Fourth, there is an advantage of counteracting stresses applied to a flat tube of a heat exchange unit and of preventing breakage of the heat exchange unit since a bending direction of a bent portion is alternately changed when the heat exchange unit is disposed in multiple rows in the case of requiring a large amount of heat exchange.

BEST MODE

Figure 1A:
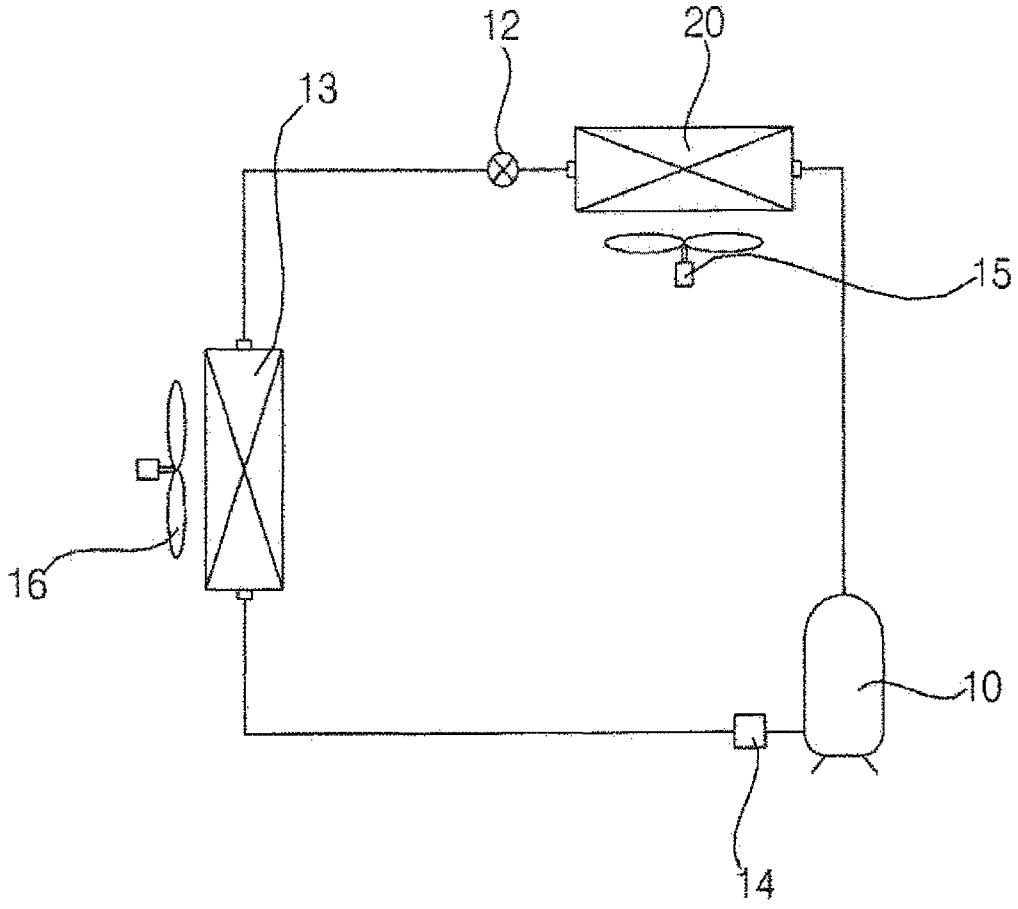
FIG. 1A is a block diagram illustrating a refrigerant cycle of a refrigerator according to a first embodiment of the present invention.

Reference will now be made in detail to embodiments, examples of which are illustrated in the accompanying drawings. However, the present disclosure may be embodied in many different forms and should not be construed as limited to the embodiments set forth herein. Rather, these embodiments are provided so that this disclosure will be thorough and complete, and will fully convey the scope of the disclosure to those skilled in the art. The present disclosure is defined only by the categories of the claims. In certain embodiments, detailed descriptions of device constructions or processes well known in the art may be omitted to avoid obscuring appreciation of the disclosure by a person of ordinary skill in the art. Wherever possible, the same reference numbers will be used throughout the drawings to refer to the same or like parts.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used in the present disclosure is for the purpose of describing particular embodiments only and is not intended to limit the disclosure. As used in the disclosure and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each layer is exaggerated, omitted, or schematically illustrated for convenience of description and clarity. Also, the size or area of each constituent element does not entirely reflect the actual size thereof.

Angles or directions used to describe the structures of light emitting devices according to embodiments are based on those shown in the drawings. Unless there is, in the specification, no definition of a reference point to describe angular positional relations in the structures of the light emitting devices, the associated drawings may be referred to.

Hereinafter, the present invention will be described in detail with reference to the accompanying drawings.

Figure 1B:
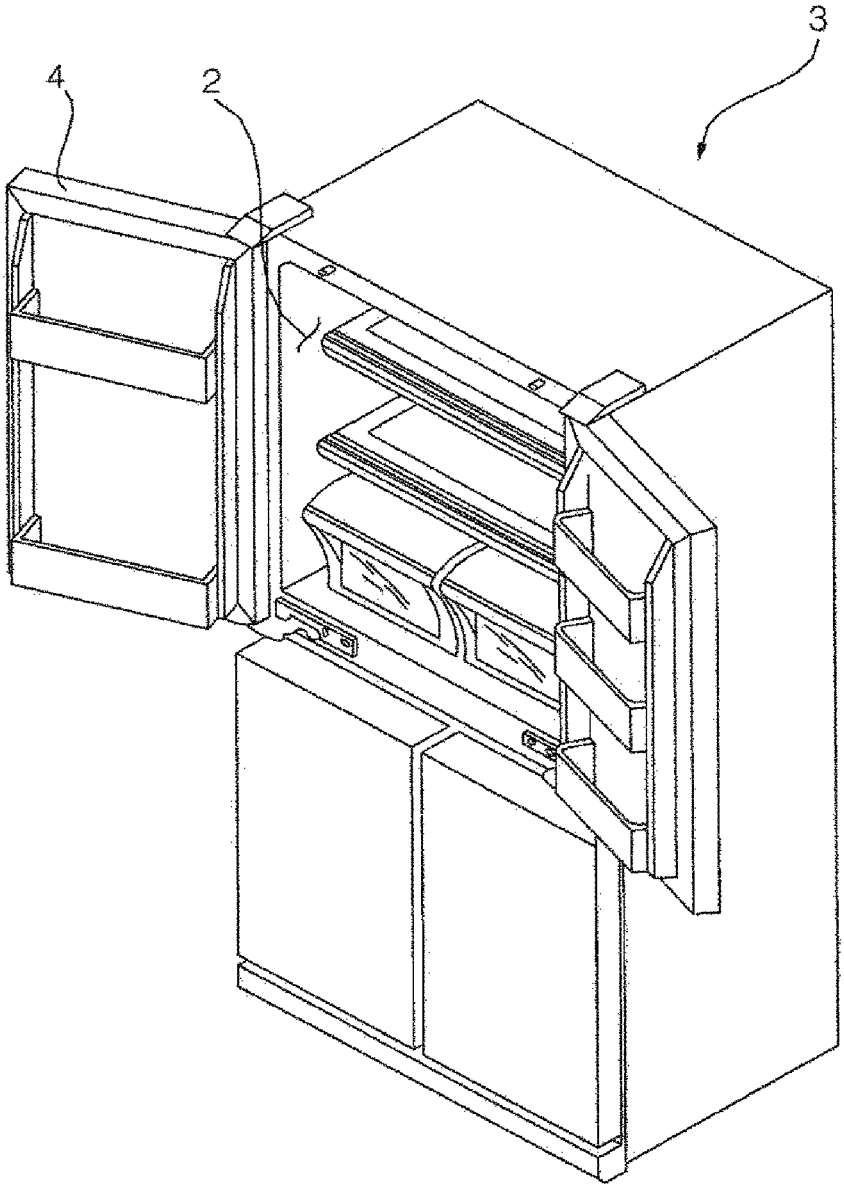
FIG. 1B is a perspective view of the refrigerator according to the first embodiment of the present invention.
Figure 2:
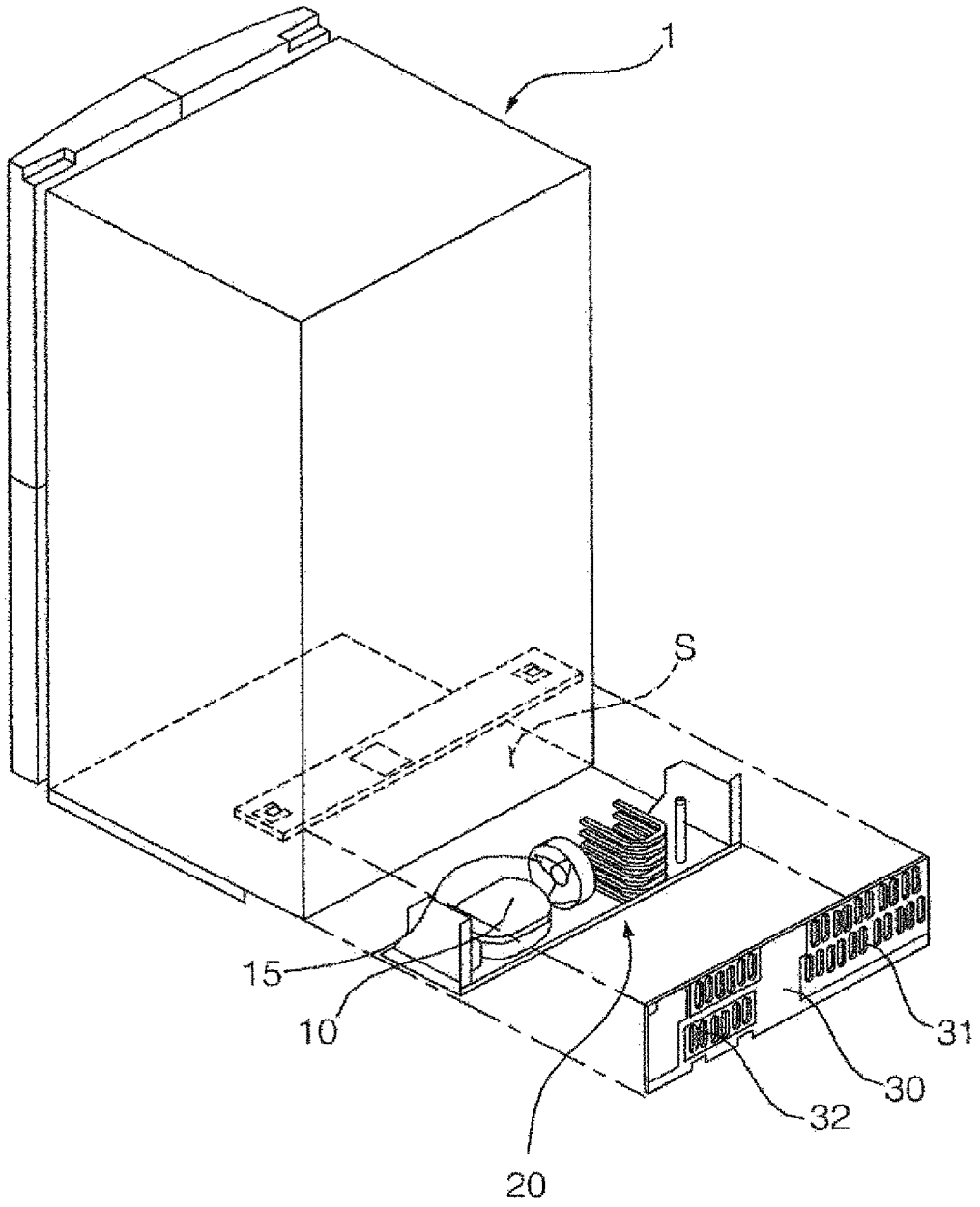
FIG. 2 is a perspective view of the machine room shown in FIG. 1.

FIG. 1A is a block diagram illustrating a refrigerant cycle of a refrigerator according to a first embodiment of the present invention. FIG. 1B is a perspective view of the refrigerator according to the first embodiment of the present invention. FIG. 2 is a perspective view of the machine room shown in FIG. 1.

Referring to FIGS. 1 and 2, the refrigerator according to an embodiment of the present invention includes a body 3 having therein a storage compartment 2 for storing foodstuffs, a door 4 for opening and closing the body 3 and a refrigeration system configured to cool the storage compartment 2.

The refrigeration system of the refrigerator according to the embodiment may include a compressor 10 configured to compress refrigerant, a condenser 20 in which the refrigerant exchanges heat with outdoor air and is then condensed, an expansion mechanism 12 configured to expand the refrigerant, and an evaporator 13 in which the refrigerant exchanges heat with the air in the refrigerator and is then evaporated.

The refrigerant, which is condensed in the compressor 10, may exchange heat with outdoor air and be condensed while passing through the condenser 20. The condenser 20 is positioned in the machine room S provided in the inside of the body 1.

The refrigerant, which is condensed in the condenser 20, may flow to the expansion mechanism 12 and may be expanded thereat. The refrigerant, which is expanded in the expansion mechanism 12, may exchange heat with the indoor air and be evaporated while passing through the evaporator 12. The evaporator 13 is disposed so as to exchange heat with the air in the storage compartment 2.

The refrigerant, which is evaporated in the evaporator 12, may be recovered to the compressor 10.

The refrigerant is circulated through the refrigeration cycle, which is composed of the compressor 10, the condenser 20, the expansion mechanism 12 and the evaporator 13.

A flow channel for the compressor 10 may be connected to the compressor 10 so as to guide the refrigerant, having passed through the evaporator 13, to the compressor 10. An accumulator 14, in which the liquid refrigerant is accumulated, may be provided at the flow channel for the compressor 10.

The machine room S may be positioned under the rear portion of the body 1. The machine room S may be configured to extend between the two lateral sides of the body 1 along the rear surface of the body 1.

The machine room S may include a rear cover 30. The rear cover 30 may be provided so as to open and close the rear surface of the machine room S. The rear cover 30 may be provided with an air inflow portion 31, through which air flows into the machine room S, and an air outflow portion 32, through which the air in the machine room S flows to the outside. Each of the air inflow portion 31 and the air outflow portion 32 may be divided into a plurality of portions. The air inflow portion 31 and the air outflow portion 32 may be provided at the rear cover so as to be disposed at different positions or to face each other.

A condenser fan 15 may be provided in the machine room S so as to blow outdoor air to the condenser 20. An evaporator fan 15 may be provided so as to blow the indoor air to the evaporator 13.

Figure 3:
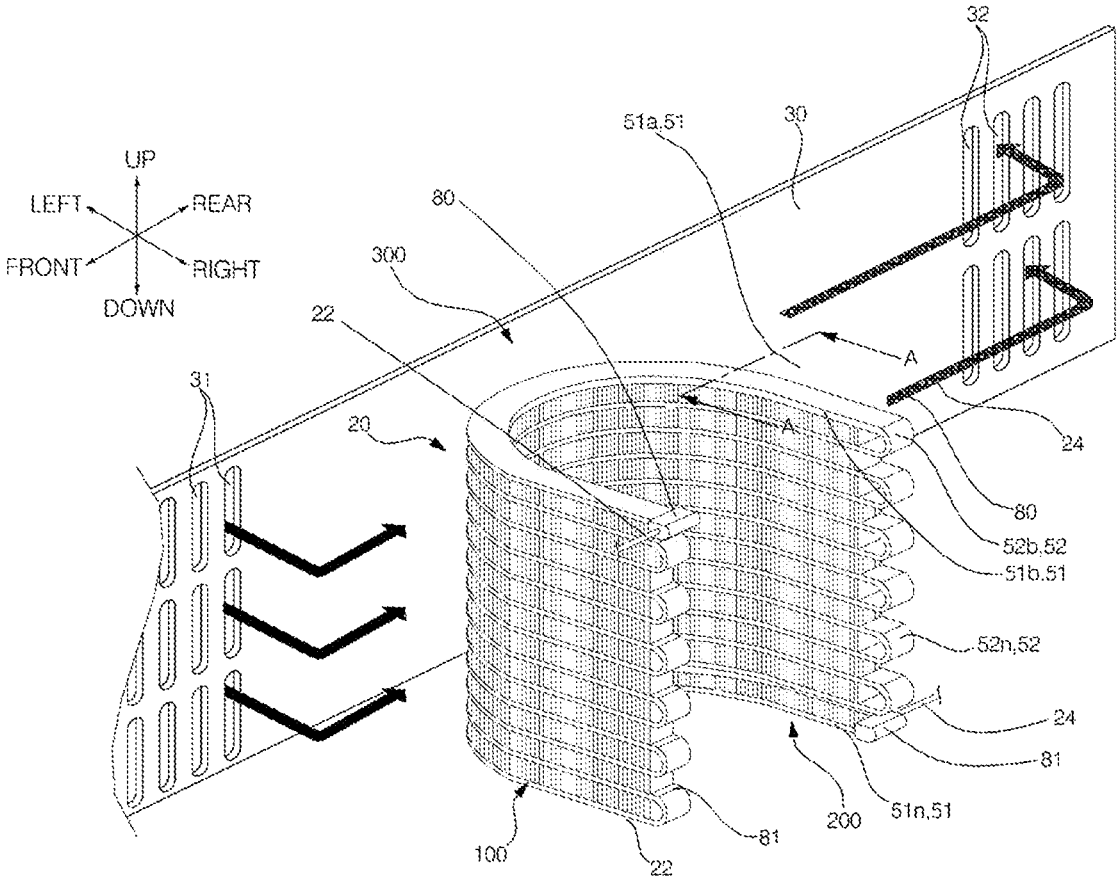
FIG. 3 is a perspective view of the condenser shown in FIG. 2.
Figure 4:
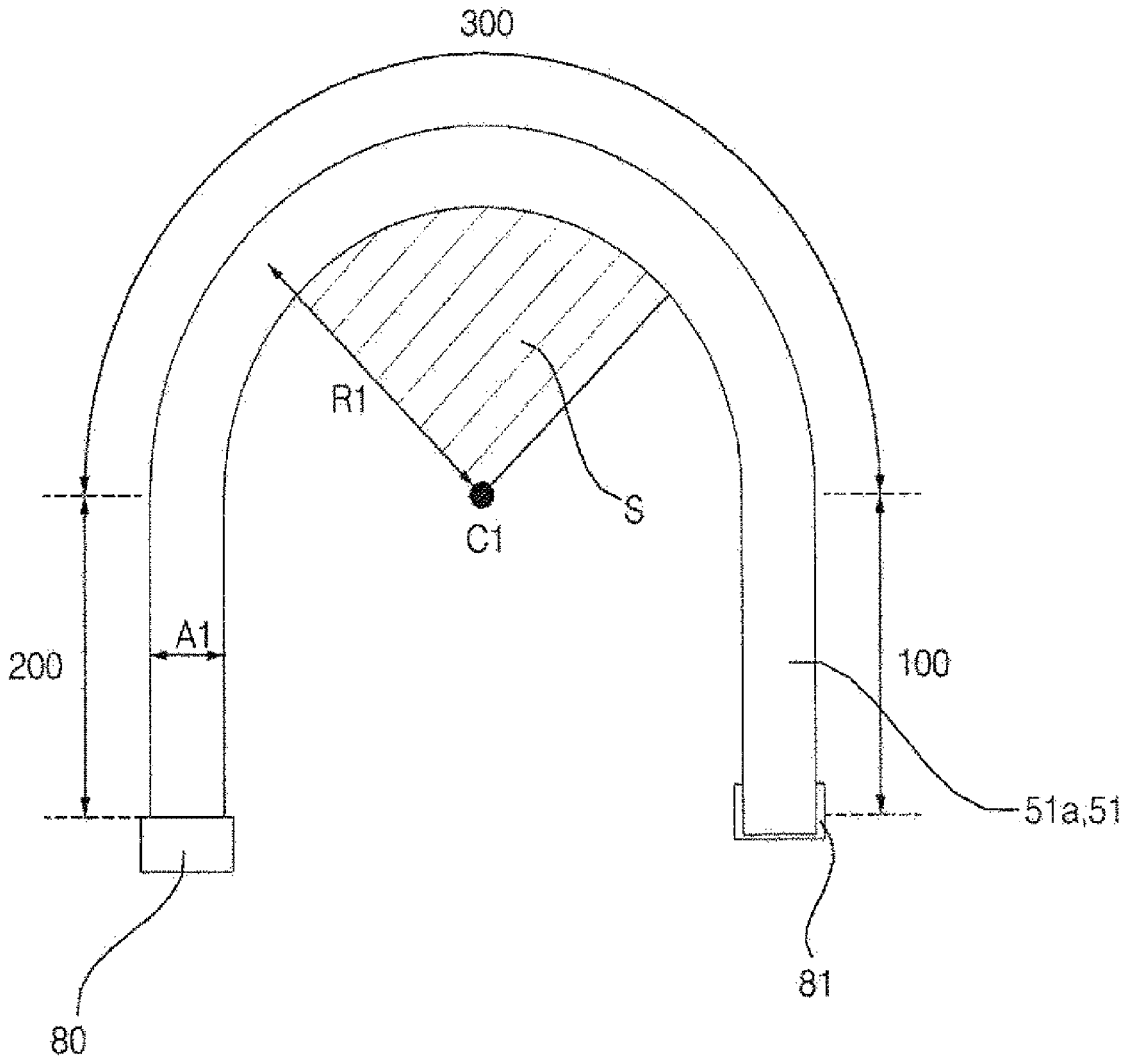
FIG. 4 is a plan view of the condenser shown in FIG. 3.
Figure 5:
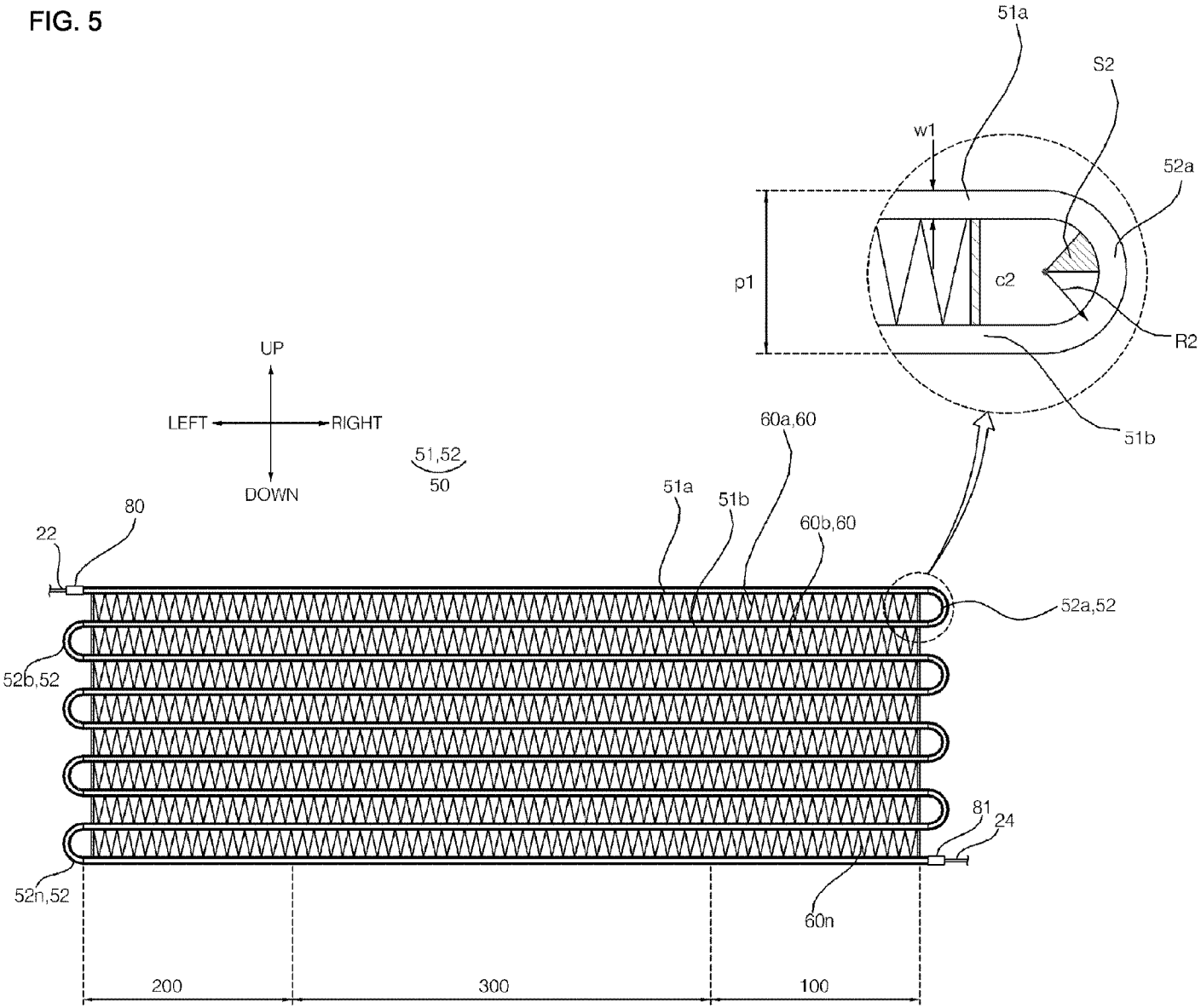
FIG. 5 is a cross-sectional view of a flat tube of the condenser shown in FIG. 3, which is flattened.

FIG. 3 is a perspective view of the condenser shown in FIG. 2. FIG. 4 is a plan view of the condenser shown in FIG. 3. FIG. 5 is a cross-sectional view of a flat tube of the condenser shown in FIG. 3, which is flattened. FIG. 6 is a cross-sectional view of a first heat exchange unit taken along line A-A in FIG. 3.

Referring to FIGS. 2 to 6, the condenser 20 is composed of at least one heat exchange unit. The heat exchange unit may be composed of a plurality of tubes coupled to each other. Here, because the plurality of tubes are coupled to each other through welding or the like, there is a disadvantage in that manufacturing thereof is difficult.

Accordingly, in order to overcome the above disadvantage, the heat exchange unit is configured such that a single flat tube 50 is bent and layered.

For example, the heat exchange unit includes a flat tube 50 defining plural rows of tubes, an inflow pipe 22, which is connected to one end of the flat tube 50 so as to supply the refrigerant thereto, and an outflow pipe 24, which is connected to the other end of the flat tube 50 so as to discharge the refrigerant.

First, the cross-sectional shape and the disposition of the flat tube 50 will be described.

Figure 6A:
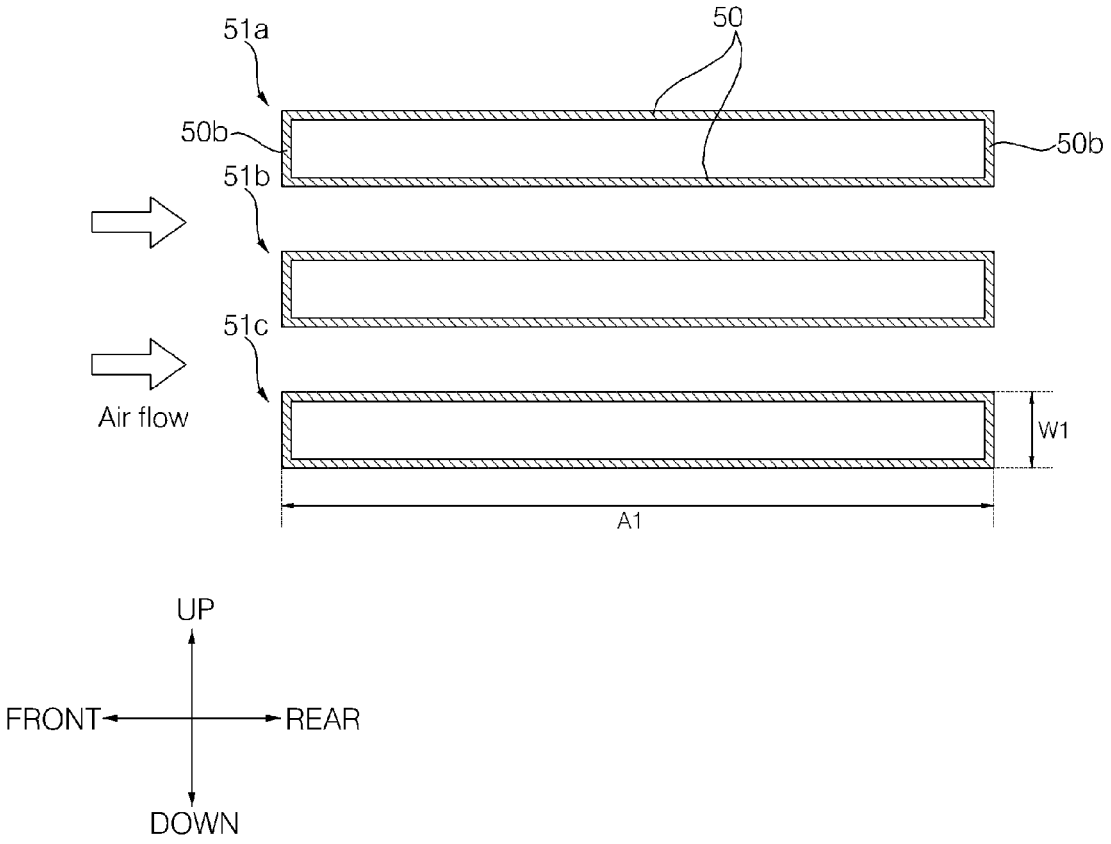
FIGS. 6A and 6B are cross-sectional views of a first heat exchange unit taken along line A-A in FIG. 3.

Referring particularly to FIG. 6A, the cross-sectional shape of the flat tube 50 may have various shapes in consideration of efficiency in heat exchange with air.

For example, when viewed in cross-section, the flat tube 50 may have various shapes such that the horizontal width A1 thereof is larger than the vertical thickness W1 thereof. Here, the horizontal width A1 of the flat tube 50 means the anteroposterior length of the flat tube 50, and the vertical thickness W1 of the flat tube 50 means the length of the flat tube 50 in the up-and-down direction.

Specifically, as illustrated in FIG. 6A, the flat tube 50 includes two longer sides 50*a*, which face each other, and two shorter sides 50*b*, which are shorter than the longer sides 50*a* and connect the two longer sides 50*a* to each other, when viewed in cross-section. The two longer sides 50*a* and the two shorter sides 50*b* define a closed space. It is preferable that each of the longer sides 50*a* have a length 2 to 20 times each of the shorter sides 50*b*.

The longer sides 50*a* of the flat tube 50 extend in a direction of airflow. In other words, the longer sides 50*a* of the flat tube 50 are disposed so as to be parallel to the anteroposterior direction, and the shorter sides 50*b* of the flat tube 50 extend in an up-and-down direction so as to intersect the longer sides 50*a*.

Consequently, since the longer sides of the flat tube 50 extend in a direction of airflow, it is possible to increase the contact area between the flat tube 50 and air and the time for which the flat tube 50 contacts air, and it is possible to improve efficiency in heat exchange.

Figure 6B:
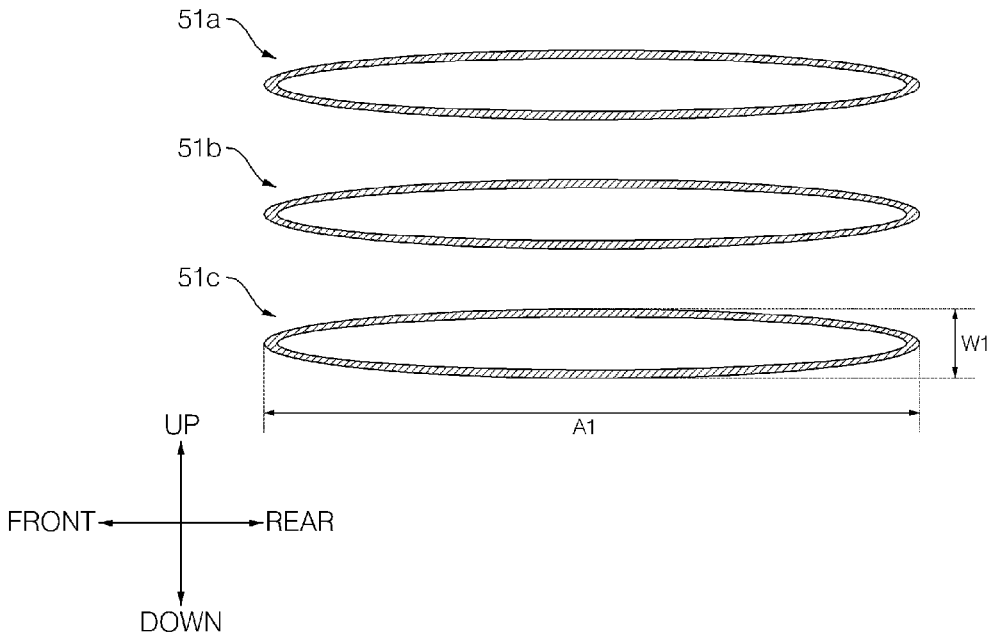

In another example, as illustrated in FIG. 6B, the flat tube 50 may have an elliptical shape such that the horizontal width A1 of the flat tube 50 is larger than the vertical thickness W1 of the flat tube 50 when viewed in cross-section.

The flat tube 50 causes the refrigerant to exchange heat with air, and receives the refrigerant through one end thereof and discharges the refrigerant through the other end thereof.

In order to efficiently perform heat exchange between the refrigerant and air in a confined space, the flat tube 50 may define plural rows of tubes 51, which are spaced apart from each other in an up-and-down direction and are layered so as to have a regular pitch. For example, the flat tube 50 is bent so as to have at least one bent tube portion 52.

Specifically, the flat tube 50 includes plural rows of tubes 51 (51*a*-51*n*), which are disposed parallel to each other, and a bent tube portion 52 connecting adjacent tube rows 51.

The plural rows of tubes 51 extend in a direction intersecting the direction of airflow. Specifically, the plural rows of tubes 51 extend horizontally, and are spaced apart from each other in an up-and-down direction at a regular pitch. Specifically, the flat tube 50 is disposed such that at least two tube rows 51 overlap each other when viewed from above.

A fin 60 is disposed between two adjacent tube rows 51 of the plural rows of tubes 51 so as to connect the adjacent tube rows 51 to each other and to conduct heat. The fin 60 connects the two adjacent tube rows 51 to each other to conduct heat. The plural rows of tubes 51, which are layered in an up-and-down direction, define a heat exchange surface in conjunction with the fins 60.

Although the length of each of the tube rows 51 is not limited, if the horizontal width A1 of the flat tube 50 is overly small, there are problems in that it is difficult to efficiently conduct heat and the number of tube rows is excessively increased, thereby increasing loss of air pressure. Accordingly, the length of each of the tube rows 51 is preferably 12 times or greater the horizontal width A1 of the flat tube 50.

Each of the bent tube portions 52 connects the left ends or the right ends of adjacent tube rows 51. Consequently, the flat tube 50 is configured such that the plural rows of tubes 51 are layered in an up-and-down direction in a zigzag fashion. Specifically, the right end of the first tub row 51*a* and the right end of the second tube row 51*b* are connected to each other via the first bent tube portion 52*a*, and the left end of the second tube row 51*b* and the left end of the third tube row 51*c* are connected to each other via the second bent tube portion 52*b*.

The bent tube portion 52 is formed by bending a portion of the flat tube 50 so as to have a predetermined curvature. The bent tube portion 52 is bent such that the flat tube 50 is disposed in a confined space and that the space in the flat tube 50, in which the refrigerant flows, does not become narrow.

A bent surface S2 of the bent tube portion 52, which defines a direction in which the bent tube portion 52 is bent, is defined. Referring to FIG. 5, the bent surface S2 of the bent tube portion 52 is defined as an imaginary plane defined by the center of one end of the bent tube portion 52, the center of the other end of the bent tube portion 52 and the center C2 of the radius of curvature of the bent tube portion 52.

In an example, the bent surface S2 of the bent tube portion 52 is disposed so as to intersect the longer side of the flat tube 50. Specifically, the bent surface S2 of the bent tube portion 52 may be a surface parallel to a horizontal plane parallel both to an up-and-down direction and to an antero-posterior direction.

If the radius of curvature of the bent tube portion 52 is excessively small, the internal space in the flat tube 50 decreases and the refrigerant does not efficiently flow. If the radius of curvature of the bent tube portion 52 is excessively large, there are disadvantages in that efficiency in heat exchange is lowered, and the volume of the condenser increases.

Accordingly, it is preferable that the ratio of the radius of curvature of the bent tube portion 52 to the vertical thickness W1 of the flat tube 50 be 5.5-7:1 and that the ratio of the vertical thickness W1 of the flat tube 50 to the pitch of the plural rows of tubes 51 be 1:5.5-7.

The length of the bent tube portion 52 is less than the length of one tube row 51. It is preferable that the ratio of the length of the bent tube portion 52 to the length of the tube row 51 be 1:10-1:100.

The inflow pipe 22 transmits the refrigerant, which is compressed in the compressor 10, to the heat exchange unit. The inflow pipe 22 is connected to one end of the flat tube 50. The inflow pipe 22 is connected to the compressor 10 so as to supply high-temperature and pressure refrigerant to the flat tube 50. Specifically, the inflow pipe 22 is connected to the left end of the first tube row 51*a*.

An inflow header 80 may be disposed between the inflow pipe 22 and the flat tube 50. The inflow header 80 connects the inflow pipe 22 having a circular section to the flat tube 50, which extends in one direction, to supply the refrigerant in the inflow pipe 22. One side and the other side of the inflow header 80 may have cross-sections different from each other, and the one side of the inflow pipe 80 may have a shape corresponding to the sectional shape of the flat tube 50.

The outflow pipe 24 transmits the refrigerant, which is compressed in the compressor 10, to the heat exchange unit. The outflow pipe 24 is connected to the other end of the flat tube 50. The outflow pipe 24 is connected to the evaporator 13 so as to supply the refrigerant, which is discharged from the flat tube 50, to the evaporator 13. Specifically, the outflow pipe 24 is connected to the right end of the last tube row (the nth tube row) 51*n*.

An outflow header 81 may be disposed between the outflow pipe 24 and the flat tube 50. The outflow header 81 connects the outflow pipe 24 having a circular section to the flat tube 50, which extends in one direction, to supply the refrigerant in the outflow pipe 24 to the flat tube 50. One side and the other side of the outflow header 81 may have different cross-sectional shapes, and the one side of the outflow header 81 may have a shape corresponding to the cross-sectional shape of the flat tube 50.

If the flat tube 50 has a plurality of bent tube portions 52 and is layered in one direction (specifically, in an up-and-down direction), there are problems in that it is difficult to efficiently dispose the heat exchange unit in a confined space and loss of air pressure increases.

Accordingly, the embodiment has a configuration in which plural rows of tubes 51 are bent in one direction. For example, the plural rows of tubes 51 may include at least two heat exchange surfaces and at least one intersection bent portion 300.

Specifically, the plural rows of tubes 51 is composed of a first heat exchange surface 100, a second heat exchange surface 200 and the intersection bent portion 300. Unlike the embodiment, the condenser 20 may also include two or more heat exchange surfaces. Here, the heat exchange surface means an imaginary surface in which the plurality of flat tubes 50 intersect a direction of airflow and are layered so as to allow air to pass therethrough while exchanging heat with air.

Each of the heat exchange surface and the intersection bent portion 300 is one of a plurality of regions formed by dividing the plural rows of tubes 51 in a longitudinal direction (in a horizontal direction). The embodiment is described as being configured such that two heat exchange surfaces are positioned at two ends in a longitudinal direction and the intersection bent portion 300 is disposed between the two heat exchange surfaces.

The first heat exchange surface 100 and the second heat exchange surface 200 may be oriented so as to intersect each other or to face each other.

For example, the first heat exchange surface 100 is disposed so as to exchange heat with air, which has exchanged heat with the second heat exchange surface 200. Specifically, the first exchange surface 100 and the second heat exchange surface 200 are disposed in a flow path along which external air flows, and the external air first exchanges heat with the second heat exchange surface 200 and secondly exchanges heat with the first heat exchange surface 100.

More specifically, the machine room S is provided with the air inflow portion 31, through which external air is introduced into the machine room, and the air outflow portion 32, through which the air, which has exchanged heat with the heat exchange unit, is discharged, and the second heat exchange surface 200 is disposed closer to the air inflow portion 31 than the first heat exchange surface 100.

The first heat exchange surface 100 and the second heat exchange surface 200 may be disposed so as to define a heat exchange surface P, which intersects a direction of airflow. The first heat exchange surface 100 and the second heat exchange surface 200 define the heat exchange surfaces, which intersect a direction of airflow and which allow air to pass therethrough while exchanging heat with the air. The first heat exchange surface 100 and the second heat exchange surface 200 may be layered in a direction of airflow. The first heat exchange surface 100 and the second heat exchange surface 200 are disposed to face each other.

The intersection bent portion 300 is defined as a region in which the tube rows 51 are bent. When the flat tube 50 is composed of plural tubes, which are disposed in multiple rows, the intersection bent portion 300 provides a bent region, thereby improving freedom in disposition and minimizing deformation of the flat tube 50, thereby maintaining efficiency of heat exchange in the heat exchange unit.

The intersection bent portion 300 is formed by plural rows of tubes 51, which are bent so as to have a predetermined curvature. The bending direction of the intersection bent portion 300 is preferably set in consideration of a degree of fatigue of the flat tube 50 and loss of air pressure due to airflow.

The intersection bent surface of the intersection bent portion 300 intersects an up-and-down direction and is disposed parallel to a direction of airflow. Here, the intersection bent surface defines the bending direction of the intersection bent portion 300. Referring to FIG. 4, the intersection bent surface S is defined as an imaginary surface defined by the center of one end of the intersection bent portion 300, the center of the other end of the intersection bent portion 300 and the center C1 of the radius of curvature of the intersection bent portion 300.

The intersection bent surface S of the intersection bent portion 300 and the bent surface S2 of the bent tube portion 52 are disposed so as to intersect each other. Specifically, the intersection bent surface S of the intersection bent section 300 defines a surface parallel both to an anteroposterior direction and to a horizontal direction, and the intersection bent surface S2 of the bent tube portion 52 defines a surface parallel to an up-and-down direction. The intersection bent surface S of the intersection bent portion 300 and the bent surface S2 of the bent tube portion 52 are disposed so as to intersect each other so as to employ a confined space in the machine room, reduce loss of air pressure and improve efficiency in heat exchange.

A direction of airflow is an anteroposterior direction, which is parallel to the intersection bent surface S of the intersection bent portion 300 and intersects the bent surface S2 of the bent tube portion 52. Accordingly, since the plural rows of tubes of the heat exchange unit are bent both in an up-and-down direction and in a horizontal direction such that the longer side 50*a* of the flat tube 50 does not intersect a direction of airflow in a predetermined space, it is possible to provide plural rows of tubes in a small space without interfering with airflow.

In other words, even when the flat tube 50 has a plurality of bent portions, the longer side 50*a* of the flat tube 50 is disposed parallel to a direction of airflow.

The intersection bent surface S of the intersection bent portion 300 is disposed parallel to the longer side of the flat tube 50. Accordingly, even when the plural rows of tubes 51 are bent, there is no interference with airflow passing through the plural rows of tubes 51.

If the radius of curvature R1 of the intersection bent portion 300 is excessively small, the internal space in the flat tube 50 becomes narrow, thereby interfering with efficient flow of the refrigerant. On the other hand, if the radius of curvature R1 of the intersection bent portion 300 is excessively large, efficiency in heat exchange is decreased and the volume of the condenser is increased.

Accordingly, the ratio of the radius of curvature R1 of the intersection bent portion 300 to the horizontal width A1 of the flat tube 50 is preferably 3-5:1.

Because the longer side 50*a* of the flat tube 50 has a length, which is 2 to 20 times the length of the shorter side 50*b*, there is difference in the limitation in the radius of curvature of the bent portion depending on the length of the side of the flat tube 50. Accordingly, the radius of curvature R1 of the intersection bent portion 300 is preferably greater than the radius of curvature R2 of the bent tube portion 52.

The intersection bent portion 300 may have the same construction and shape as the plural rows of tubes 51. However, the intersection bent portion 300 may be made of a material different from the flat tube 50 in order to realize a bent-type layered structure capable of efficiently utilizing a space. Specifically, the intersection bent portion 300 may be made of a softer material than the flat tube 50 so as to be easily bent.

The cross-sectional shape of the flat tube 50 is maintained as in FIG. 6 in the heat exchange surfaces and the intersection bent portion 300.

The length of the intersection bent portion 300 is shorter than the length D1 of the flat tube 50 and the length of the first and second heat exchange surfaces. The ratio of the length of the intersection bent portion 300 to the length of the heat exchange surface is preferably 1:1-1:10.

The length of the intersection bent portion 300 is greater than the horizontal width A1 of the flat tube 50. The length of the intersection bent portion 300 may be 1.2 times the horizontal width A1 of the flat tube 50.

The sum of the lengths of the first heat exchange surface 100, the second heat exchange surface 200 and the intersection bent portion 300 is preferably 13 times or more the horizontal width A1 of the flat tube 50. The reason for this is because efficient heat transfer is difficult and loss of air pressure is increased due to increased rows of tubes 51 if the sum of the lengths of the first heat exchange surface 100, the second heat exchange surface 200 and the intersection bent portion 300 is excessively small.

Figure 7:
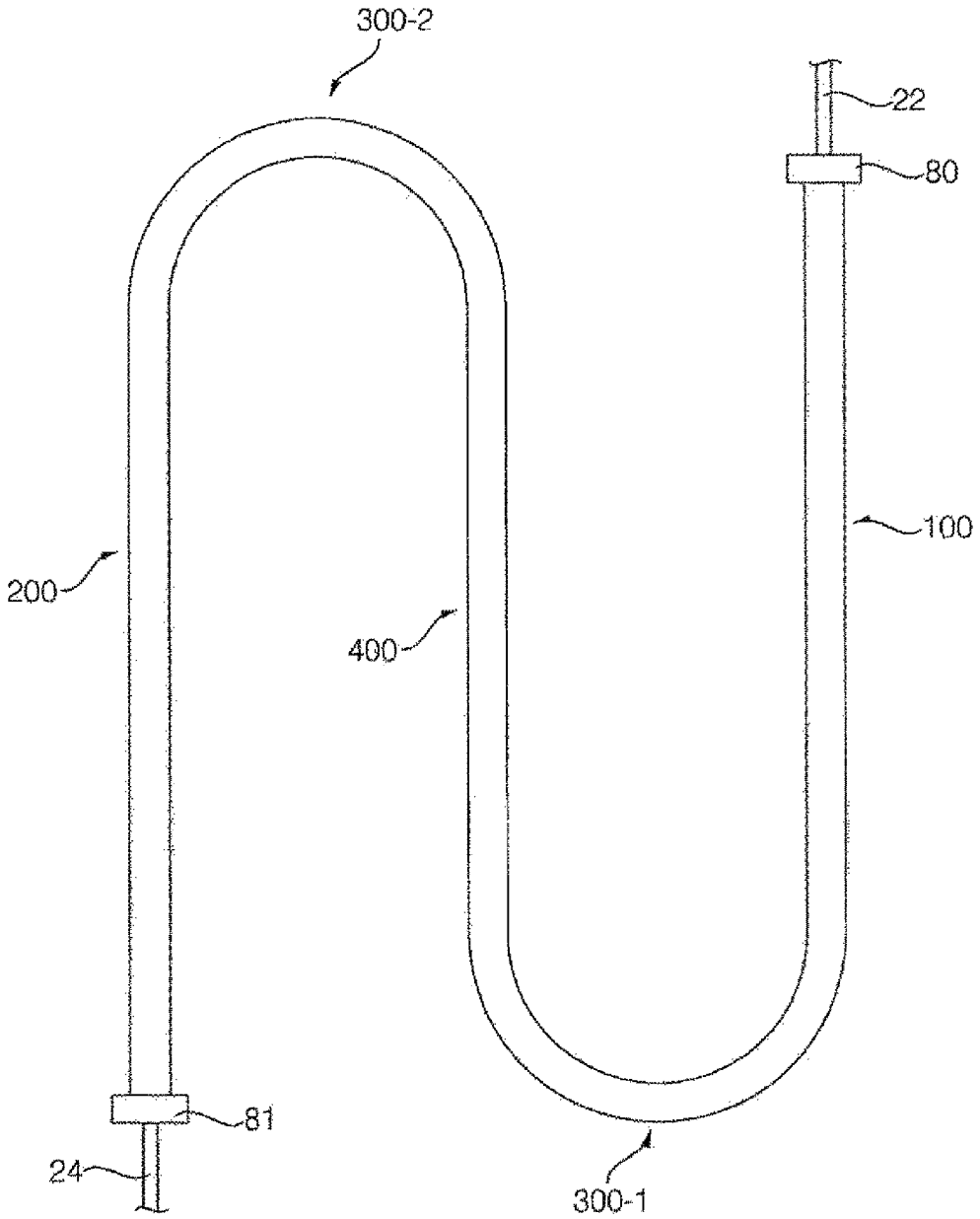
FIG. 7 is a plan view of a condenser according to a second embodiment of the present invention.

FIG. 7 is a plan view of a condenser 20 according to a second embodiment of the present invention.

There is a difference between the first embodiment and the second embodiment in that the second embodiment further includes an intermediate heat exchange surface 400.

Referring to FIG. 7, the intermediate heat exchange surface 400 defines at least one row between the first heat exchange surface 100 and the second heat exchange surface 200. The intermediate heat exchange surface 400, the first heat exchange surface 100 and the second heat exchange surface 200 define plural rows of heat exchange surfaces, which intersect a direction of airflow.

The intermediate heat exchange surface 400 is connected to the first heat exchange surface 100 and the second heat exchange surface 200 via at least two intersection bent portions 300. Although the construction of the intermediate heat exchange surface 400 is almost the same as the construction of the first heat exchange surface 100, there are differences in that the header is not connected to the intermediate heat exchange surface 400 and the intersection bent portions 300 are connected to the two ends of the intermediate heat exchange surface 400.

A first intersection bent portion 300-1, which connects the first heat exchange surface 100 to one end of the intermediate heat exchange surface 400, is bent in a clockwise direction along the intersection bent surface S. A second intersection bent portion 300-2, which connects the second heat exchange surface 200 to the other end of the intermediate heat exchange surface 400, is bent in a counterclockwise direction along the intersection bent surface S. In other words, since the bending direction of the first intersection bent portion 300 (300-1) and the bending direction of the second intersection bent portion 300 (300-1) are opposite each other, the stress concentrated on the first heat exchange surface 100, the intermediate heat exchange surface 400 and the second heat exchange surface 200 is alleviated.

Accordingly, since plural rows of heat exchange units are disposed in a confined space while the surface area of heat exchange of the heat exchange units is increased, it is possible to optimize space utilization and to prevent concentration of stress by alternately changing the bending direction.

Figure 8:
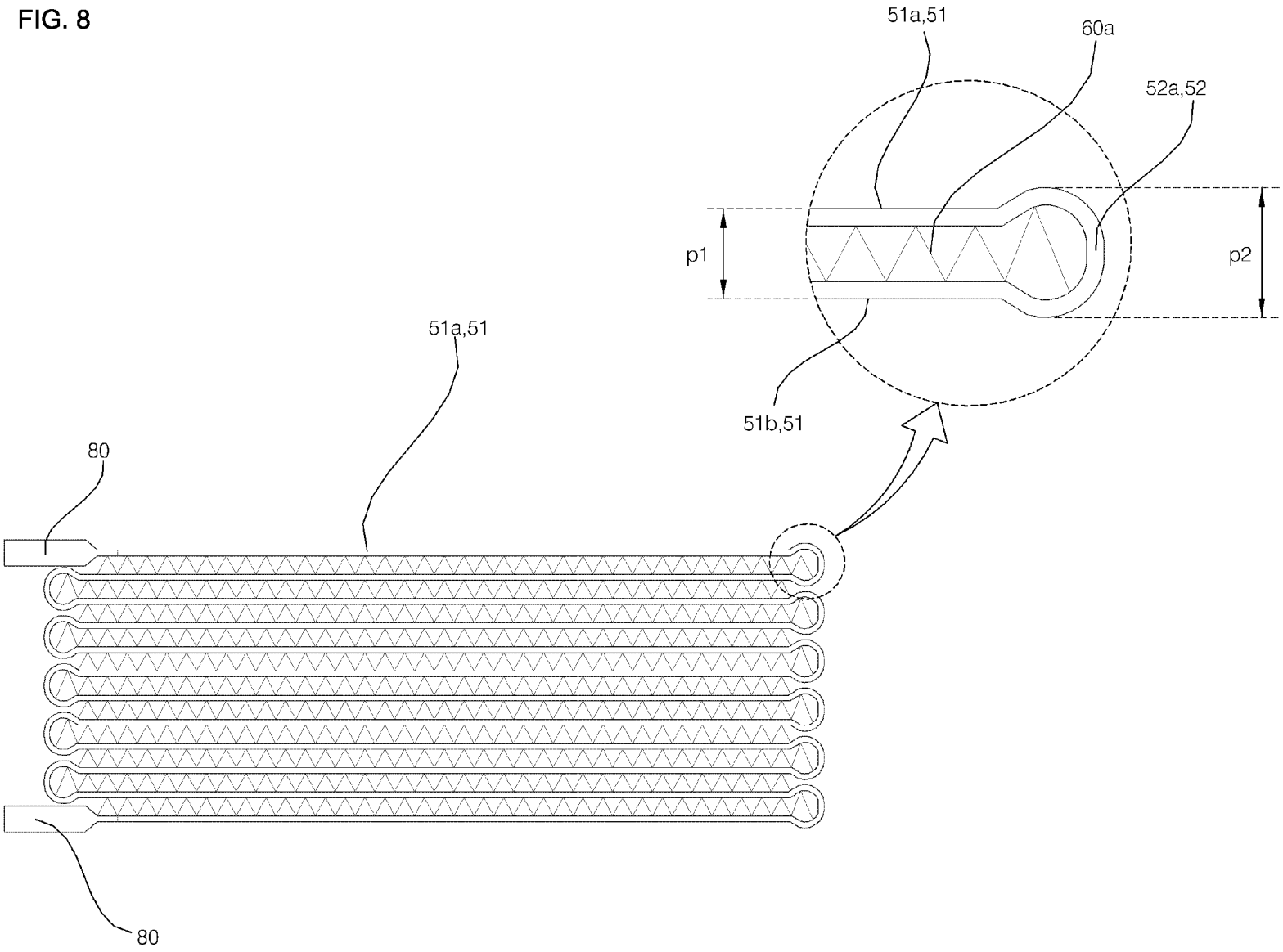
FIG. 8 is a cross-sectional view of a flat tube of a condenser according to a third embodiment of the present invention in the unfolded state.

FIG. 8 is a cross-sectional view of a flat tube 50 of a condenser according to a third embodiment of the present invention in the unfolded state.

The third embodiment has differences in the fin 60 and the tube bent portion 52, compared to the first embodiment.

Referring to FIG. 8, the diameter P2 of the bent tube portion 52 is larger than the pitch of the plural rows of tubes 51. Specifically, the diameter P2 of the bent tube portion 52 is preferably 1.1 to 1.8 times the pitch of the plural rows of tubes 51. The reason for this is that the adjacent bent tube portions 52 interfere with each other if the diameter P2 of the bent tube portion 52 is excessively large and because the flat tube 50 is damaged during a bending operation if the diameter P2 of the bent tube portion 52 is excessively small.

Particularly, since the diameter P2 of the bent tube portion 52 is larger than the pitch of the plural rows of tubes 51, stress applied to the flat tube 50 is alleviated. Furthermore, since the fin 60 is also provided in the space in the bent tube portion 52, it is possible to improve efficiency in heat transfer.

Here, the fin 60 is disposed not only between the plural rows of tubes 51 but also in the internal space in the bent tube portion 52 without a finless region.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

[Description of Reference Numerals]

| | |
|---|---|
| 10: compressor | 12: expansion mechanism |
| 13: evaporator | 14: accumulator |
| 15: condenser fan | 16: evaporator fan |
| 20: condenser | 22: inflow pipe |
| 24: outflow pipe | 50: flat tube |
| 60: fin | |

The invention claimed is:

1. A condenser for a refrigerator, the condenser comprising:

a heat exchange unit configured to receive, at one side thereof, refrigerant which has been compressed in a compressor, to perform heat exchange between the refrigerant and air, and to discharge the refrigerant, which has exchanged heat with the air, to an evaporator, wherein the heat exchange unit includes a flat tube, through one end of which the refrigerant is introduced and through a remaining end of which the refrigerant is discharged, thereby performing heat exchange between the refrigerant and the air, wherein the flat tube includes at least one bent tube portion defining plural rows of tubes, which are spaced apart from each other in an up-and-down direction, wherein the plural rows of tubes define an intersection bent portion, which has a predetermined curvature and intersects the up-and-down direction, wherein a bent tube surface of the intersection bent portion and a bent surface of the bent tube portion are positioned in directions so as to intersect each other, wherein the intersection bent portion has a radius of curvature which is larger than a radius of curvature of the bent tube portion, wherein the flat tube has a longer side which is positioned parallel to the bent surface of the intersection bent portion, wherein the longer side of the flat tube is positioned in a direction so as to intersect the bent surface of the bent tube portion, wherein each of the bent tube portions connects left ends or right ends of adjacent pairs of the plurality of rows of tubes, and the flat tube is configured such that the plural rows of tubes are layered in the up-and-down direction in a zigzag fashion, and wherein a pitch of the row of the tithes is smaller than a diameter of the bent tube portion.

2. The condenser for a refrigerator according to claim 1, wherein the flat tube has a horizontal width which is larger than a vertical thickness of the flat tube.

3. The condenser for a refrigerator according to claim 1, wherein a ratio of a radius of curvature of the intersection bent portion to a horizontal width of the flat tube is 3-5:1.

4. The condenser for a refrigerator according to claim 1, wherein a ratio of the bent tube portion to a vertical thickness of the flat tube is 5.5-7:1.

5. The condenser for a refrigerator according to claim 1, wherein a ratio of a vertical thickness of the flat tube to a pitch of the plural rows of tubes is 1:5.5-7.

6. The condenser for a refrigerator according to claim 1, further comprising:

an inflow header configured to supply the refrigerant, which has been compressed in the compressor, to the heat exchange unit, and an outflow header through which the refrigerant, which has exchanged heat with the air in the heat exchange unit, flows, wherein the inflow header is connected to the one end of the flat tube, and the outflow header is connected to the remaining end of the flat tube.

7. The condenser for a refrigerator according to claim 1, further comprising a fin connecting the plural rows of tubes to each other in order to transfer heat.

8. The condenser for a refrigerator according to claim 1, wherein the plural rows of tubes define two heat exchange surfaces, which face each other.

9. The condenser for a refrigerator according to claim 1, wherein the bent surface of the bent tube portion is parallel to the up-and-down direction.

10. The condenser for a refrigerator according to claim 1, wherein the intersection bent portion is perpendicular to the up-and-down direction.

11. The condenser for a refrigerator according to claim 1, wherein a direction in which the air flows is parallel to the bent surface of the intersection bent portion and intersects the bent surface of the bent tube portion.

12. The condenser for a refrigerator according to claim 1, wherein a pitch of the row of the tubes corresponds to a diameter of the bent tube portion.

13. The condenser for a refrigerator according to claim 1, wherein the flat tube has a rectangular cross-sectional shape.

14. The condenser for a refrigerator according to claim 1, wherein the flat tube has an oval cross-sectional shape.

15. The condenser for a refrigerator according to claim 1, wherein the flat tube includes one intersection bent portion such that the condenser has a U-shape when viewed in plan.

16. A refrigerator comprising:

a body having a storage compartment for storing foodstuffs;

a door configured to open and close the body; and a condenser configured to condense refrigerant for cooling the storage compartment, wherein the condenser includes a heat exchange unit configured to receive at one side thereof the refrigerant, which has been compressed in a compressor, to perform heat exchange between the refrigerant and air and to discharge the refrigerant, which has exchanged heat with the air, to an evaporator, wherein the heat exchange unit includes a flat tube, through one end of which the refrigerant is introduced and through a remaining end of which the refrigerant is discharged, thereby performing heat exchange between the refrigerant and the air, wherein the flat tube includes at least one bent tube portion defining plural rows of tubes, which are spaced apart from each other in an up-and-down direction, wherein the plural rows of tubes define an intersection bent portion, which has a predetermined curvature and intersects the up-and-down direction, wherein a bent tube surface of the intersection bent portion and a bent surface of the bent tube portion are positioned in directions so as to intersect each other, wherein the intersection bent portion has a radius of curvature which is larger than a radius of curvature of the bent tube portion, wherein the flat tube has a longer side which is positioned parallel to the bent surface of the intersection bent portion, wherein the longer side of the flat tube is positioned in a direction so as to intersect the bent surface of the bent tube portion, and wherein each of the bent tube portions connects left ends or right ends of adjacent pairs of the plurality of rows of tubes, and the flat tube is configured such that the plural rows of tubes are layered in the up-and-down direction in a zigzag fashion, wherein a pitch of the row of the tubes is smaller than a diameter of the bent tube portion.

17. The refrigerator according to claim 16, wherein the intersection bent portion is perpendicular to the up-and-down direction.

18. The refrigerator according to claim 16, wherein a direction in which the air flows is parallel to the bent surface of the intersection bent portion and intersects the bent surface of the bent tube portion.

19. A condenser for a refrigerator the condenser comprising:

a heat exchange unit configured to receive, at one side thereof, refrigerant which has been compressed in compressor, to perform heat exchange between the refrigerant and air, and to discharge the refrigerant, has exchanged heat with the air, to an evaporator, wherein the heat exchange includes a flat tube through one end of which the refrigerant is introduced and through a remaining end of which the refrigerant is discharged, thereby performing heat exchange between the refrigerant and the air, wherein the flat tube includes at least one bent tube portion defining plural rows of tubes, which are spaced apart from each other in an up-and-down direction, wherein the plural rows of tubes define an intersection bent portion, which has a predetermined curvature and intersects the up-and-down direction, wherein the bent tube surface of the intersection bent portion and a bent surface of the bent tube portion are positioned in directions so as to intersect each other, wherein the intersection bent portion has a radius of curvature is larger than a radius of curvature of the bent tube portion, wherein the flat tube has a longer side which is positioned parallel to the bent surface of the intersection bent portion, wherein the longer side of the flat tube is positioned in a direction so as to intersect the bent surface of the bent tube portion, wherein each of the bent tube portions connects left ends or right ends of adjacent pairs of the plurality of rows of tubes, and the flat tube is configured such that the plural rows of tubes are layered in the up-and-down direction in a zigzag fashion, and wherein the flat tube includes at least two intersection bent portions such that the condenser has an S-shape when viewed in plan.

20. A refrigerator comprising:

a body having a storage compartment for storing foodstuffs;

a door configured to open and close the body; and a condenser configured to condense refrigerant for cooling the storage compartment, wherein the condenser includes a heat exchange unit configured to receive at one side thereof the refrigerant, which has been compressed in a compressor, to perform heat exchange between the refrigerant and air and to discharge the refrigerant, which has exchanged heat with the air, to an evaporator, wherein the heat exchange unit includes a flat tube, through one end of which the refrigerant is introduced and through a remaining end of which the refrigerant is discharged, thereby performing heat exchange between the refrigerant and the air, wherein the flat tube includes at least one bent tube portion defining plural rows of tubes, which are spaced apart from each other in an up-and-down direction, wherein the plural rows of tubes define an intersection bent portion, which has a predetermined curvature and intersects the up-and-down direction, wherein the bent tube surface of the intersection bent portion and a bent surface of the bent tube portion are positioned in directions so as to intersect each other, wherein the intersection bent portion has a radius of curvature which is larger than a radius of curvature of the bent tube portion, wherein the flat tube has a longer side which is positioned parallel to the bent surface of the intersection bent portion, wherein the longer side of the flat tube is positioned in a direction so as to intersect the bent surface of the bent tube portion, wherein each of the bent tube portions connects left ends or right ends of adjacent pairs of the plurality of rows of tubes, and the flat tube is configured such that the plural rows of tubes are layered in the up-and-down direction in a zigzag fashion, and wherein the flat tube includes at least two intersection bent portions such that the condenser has an S-shape when viewed in plan.

* * * * *